US007356450B2

(12) United States Patent
Huang

(10) Patent No.: US 7,356,450 B2
(45) Date of Patent: Apr. 8, 2008

(54) METHODS FOR DESIGNING ROLLER CONE BITS BY TENSILE AND COMPRESSIVE STRESSES

(75) Inventor: Sujian J. Huang, Beijing (CN)

(73) Assignee: Smith International, Inc., Houston, TX (US)

( * ) Notice: Subject to any disclaimer, the term of this patent is extended or adjusted under 35 U.S.C. 154(b) by 454 days.

(21) Appl. No.: 11/009,973

(22) Filed: Dec. 10, 2004

(65) Prior Publication Data

US 2005/0159937 A1 Jul. 21, 2005

Related U.S. Application Data

(63) Continuation-in-part of application No. 09/635,116, filed on Aug. 9, 2000, now Pat. No. 6,873,947, which is a continuation of application No. 09/524,088, filed on Mar. 13, 2000, now Pat. No. 6,516,293.

(51) Int. Cl.
*G06G 7/48* (2006.01)

(52) U.S. Cl. ..... 703/10; 703/2; 175/39; 175/57; 175/431; 702/9

(58) Field of Classification Search ..... 703/2, 703/10; 175/57, 431; 702/9
See application file for complete search history.

(56) References Cited

U.S. PATENT DOCUMENTS

| | | | | |
|---|---|---|---|---|
| 4,408,671 | A | 10/1983 | Munson | |
| 4,815,342 | A | 3/1989 | Brett et al. | |
| 5,787,022 | A | 7/1998 | Tibbitts et al. | |
| 5,864,058 | A | 1/1999 | Chen | |
| 5,868,213 | A | 2/1999 | Cisneros et al. | |
| 5,950,747 | A | 9/1999 | Tibbitts et al. | |
| 6,021,377 | A * | 2/2000 | Dubinsky et al. | 702/9 |
| 6,078,869 | A * | 6/2000 | Gunasekera | 702/6 |
| 6,095,262 | A | 8/2000 | Chen | |
| 6,106,561 | A * | 8/2000 | Farmer | 703/10 |
| 6,213,225 | B1 | 4/2001 | Chen | |
| 6,233,524 | B1 * | 5/2001 | Harrell et al. | 702/9 |
| 6,241,034 | B1 | 6/2001 | Steinke et al. | |
| 6,260,639 | B1 * | 7/2001 | Yong et al. | 175/431 |

(Continued)

FOREIGN PATENT DOCUMENTS

| | | |
|---|---|---|
| SU | 933932 | 6/1982 |

(Continued)

OTHER PUBLICATIONS

"Drilling Optimization Software Verified in the North Sea", Bratli et al, SPE 39007, SPE 1997.*

(Continued)

*Primary Examiner*—Fred Ferris
(74) *Attorney, Agent, or Firm*—Osha Liang LLP

(57) ABSTRACT

A method for designing a roller cone bit that includes steps of selecting design parameters for the roller cone bit, drilling parameters, and parameters of an earth formation, simulating drilling of the earth formation by the roller cone bit using the selected drilling parameters, calculating drilling performance parameters from the simulated drilling, and analyzing at least one of a tensile stress or a compressive stress parameters for a cutting element of the roller cone bit from the calculated drilling performance parameters is disclosed.

11 Claims, 6 Drawing Sheets

U.S. PATENT DOCUMENTS

| | | | | |
|---|---|---|---|---|
| 6,290,006 | B1 | 9/2001 | Crawford | |
| 6,349,595 | B1 * | 2/2002 | Civolani et al. | 73/152.02 |
| 6,401,839 | B1 | 6/2002 | Chen | |
| 6,412,577 | B1 * | 7/2002 | Chen | 175/57 |
| 6,424,919 | B1 * | 7/2002 | Moran et al. | 702/6 |
| 6,516,293 | B1 | 2/2003 | Huang et al. | |
| 6,986,395 | B2 * | 1/2006 | Chen | 175/39 |
| 7,085,696 | B2 * | 8/2006 | King | 703/10 |
| 2004/0236553 | A1 * | 11/2004 | Chen et al. | 703/10 |
| 2005/0165592 | A1 * | 7/2005 | Huang | 703/7 |

FOREIGN PATENT DOCUMENTS

| | | | |
|---|---|---|---|
| SU | 1461855 | A1 | 2/1989 |
| SU | 1654515 | A1 | 7/1991 |
| SU | 1691497 | A1 | 11/1991 |
| WO | WO-00/12859 | | 3/2000 |
| WO | WO-00/12860 | | 3/2000 |

OTHER PUBLICATIONS

"The wear transition as means for hardmetal fracture toughness evaluation", Scieszka, International Journal of Refractory and Hard Meaterials, Aug. 19, 2000.*

"Prediction of the penetration rate of rotary blast hole drills using a new drillability index", Kahraman et al, International Journal of Rock Mechanics and Mining Sciences 37, Dec. 1999.*

Certification and Notarization dated Nov. 12, 2003 from Universe Technical Translation.

Translation of Description of Invention No. 933932 dated Jun. 7, 1982 (2 pages).

D. Ma, et al. "Dynamics of Roller Cone Bits", Journal of Energy Resources Technology, Dec. 1985, vol. 107 (pp. 543-548).

D. Ma, et al. "A New Way to Characterize the Gouging-Scraping Action of Roller Cone Bits", Society of Petroleum Engineers, 1989 (24 pgs.).

Boris L. Steklianov, "Increasing the Efficiency of Rock-Cutting Tools on the Basis of Comparative Analysis of the Kinetic Characteristics of Their Cutting Structure"; NDERI, 1990 (24 pages).

Robert L. McIntyre, "Surface Mine Rotary Drilling", Smith-Gruner (3 pages), no date.

RockBit International, "System Designed to Speed Continuous Coring Operation", (4 pages), no date.

RockBit International, "If You've Ever Doubted RBI's Ability to Drill at a Lower Cost Per Foot . . . Ask the Folks Drilling This Well", (4 pages), no date.

RockBit International, "The Leader in High-Speed Drill Bit Technology" (24 pages), no date.

Sandvik Rock Bits, "Sandvik in the World of Oil and Gas" (8 pages), no date.

B. L. Steklyanov, et al.; "Improving the Effectiveness of Drilling Tools"; KhM-3 Oil Industry Machine Building; (1991) pp. 1-35.

Dekun Ma, et al.; "The Computer Simulation of the Interaction Between Roller Bit and Rock"; International Meeting on Petroleum Engineering; PR China; Nov. 14-17, 1995; pp. 309-317.

Ma Dekun, et al., "The Operational Mechanics of The Rock Bit", Petroleum Industry Press, 1996, pp. 1-243.

Society of Petroleum Engineers Paper No. 56439, "Field Investigation of the Effects of Stick-Slip, Lateral, and Whirl Vibrations on Roller Cone Bit Performance", S.L. Chen, et al., presented Oct. 3-6, 1999, (10 pages).

Society of Petroleum Engineers Paper No. 71053, "Development and Application of a New Roller Cone Bit with Optimized Tooth Orientation", S. L. Chen, et al., presented May 21-23, 2001 (15 pages).

Society of Petroleum Engineers Paper No. 71393, "Development and Field Applications of Roller Cone Bits with Balanced Cutting Structure", S. L. Chen, et al., presented Sep. 30-Oct. 3, 2001 (11 pages).

Hancke, et al., G.P. A Control System for Optimizing Deep Hole Drilling Conditions, IECON 1991 International Conference on Industrial Electronics, Control and Instrumentation, 1991, pp. 2279-2284.

Ertunc, et al., H. M. Real Time Monitoring of Tool Wear Using Multiple Modeling Method, IEEE International Electric Machines and Drives Conference, IEMDC 2001, pp. 687-691.

Hancke, G. P. The Effective Control of a Deep Hole Diamond Drill, Conference Record of the IEEE Industry Applications Society Annual Meeting, 1991, pp. 1200-1205.

Howie, et al., W. L. A Smart Bolter for Improving Entry Stability, Conference Record of the IEEE Industry Applications Society Annual Meeting, 1989, pp. 1556-1564.

Translation of Description of Invention No. 295857 dated Feb. 12, 1971 (2 pages).

Translation of Description of Invention No. 398733 dated Sep. 27, 1973 (2 pages).

Translation of Description of Invention No. 420749 dated Mar. 25, 1974 (2 pages).

Translation of Description of Invention No. 229371 dated Oct. 23, 1968 (1 page).

Translation of Description of Invention No. 436147 dated Jul. 15, 1974 (2 pages).

Translation of Description of Invention No. 469801 dated May 5, 1975 (2 pages).

Translation of Description of Invention No. 515867 dated May 30, 1976 (2 pages).

Palashchenko, et al.; "Study of Roller Cone Bits With Disk Rink Inserts"; Neftyanoye Khozyaystvo (Oil Industry), Issue 11, 1987 (4 pages).

Rudolf C.O. Pessier, et al. "Rolling Cone Bits With Novel Gauge Cutting Structure" Drill Faster, More Efficiently, SPE 30473; 1995.

M. C. Sheppard, et al. "The Forces at the Teeth of a Drilling Rollercone bit: Theory and Experiment", SPE 18042; 1988 (pp. 253-260).

"Longer Useful Lives for Roller Bits Cuts Sharply Into Drilling Costs" S.A. Mining & Engineering Journal, Mar. 1979, (pp. 39-43).

Johannes D. Brakel, "Prediction of Wellbore Trajectory Considering Bottom Hole Assembly and Drill Bit Dynamics", The University of Tulsa, (66 pages), 1986.

R. K. Dropek, et al. "A Study to Determine Roller Cone Cutter Offset Effects at Various Drilling Depths", ASME vol. 78-Pet-23, (10 pages), Aug. 1979.

Doodnath Ramsunder "Bit Deviation Forces Due to Rock-Bit Interaction" University of Tulsa, (66 pages), 1976.

E. I. Umez-Eronini, "Rotary Drill Bit/Rock Model with Cutter Offset" Journal of Energy Resources Technology, vol. 105, Sep. 1983 (3 pages).

D. Ma, et al. "Kinematics of the Cone Bit" SPE 10563; Jun. 1985 (30 pages).

* cited by examiner

| Cone | Row | Tstress_max (1000*psi) | Tstress_median (1000*psi) | Tstress_aver (1000*psi) | Counts | Angle |
|---|---|---|---|---|---|---|
| 1 | | 151.170 | 22.631 | 28.263 | | |
| 1 | 1 | 0.000 | 0.000 | 0.000 | 16 | 0.00 |
| 1 | 2 | 103.777 | 8.809 | 17.297 | 16 | 0.00 |
| 1 | 3 | 63.132 | 11.996 | 13.652 | 14 | 0.00 |
| 1 | 4 | 151.170 | 7.421 | 10.277 | 8 | 0.00 |
| 1 | 5 | 145.084 | 3.226 | 10.853 | 1 | 0.00 |
| 2 | | 143.863 | 36.332 | 39.035 | | |
| 2 | 1 | 0.000 | 0.000 | 0.000 | 13 | 0.00 |
| 2 | 2 | 120.693 | 8.719 | 16.537 | 13 | 0.00 |
| 2 | 3 | 73.411 | 22.632 | 22.476 | 13 | 0.00 |
| 2 | 4 | 60.029 | 5.984 | 7.945 | 11 | 0.00 |
| 2 | 5 | 143.863 | 22.821 | 30.144 | 3 | 0.00 |
| 3 | | 192.901 | 32.691 | 36.928 | | |
| 3 | 1 | 0.000 | 0.000 | 0.000 | 11 | 0.00 |
| 3 | 2 | 120.292 | 6.012 | 14.387 | 11 | 0.00 |
| 3 | 3 | 133.040 | 25.875 | 29.085 | 11 | 0.00 |
| 3 | 4 | 39.766 | 3.598 | 5.434 | 13 | 0.00 |
| 3 | 5 | 148.828 | 15.424 | 18.479 | 5 | 0.00 |
| 3 | 6 | 192.901 | 3.226 | 11.150 | 1 | 0.00 |

| Cone | Row | Cstress_max (1000*psi) | Cstress_median (1000*psi) | Cstress_aver (1000*psi) | Counts | Angle |
|---|---|---|---|---|---|---|
| 1 | | 210.064 | 88.820 | 88.813 | | |
| 1 | 1 | 0.204 | 0.000 | 0.000 | 16 | 0.00 |
| 1 | 2 | 95.672 | 7.542 | 14.373 | 16 | 0.00 |
| 1 | 3 | 134.501 | 42.221 | 40.570 | 14 | 0.00 |
| 1 | 4 | 147.461 | 37.713 | 35.789 | 8 | 0.00 |
| 1 | 5 | 69.441 | 14.967 | 18.145 | 1 | 0.00 |
| 2 | | 231.987 | 95.532 | 97.029 | | |
| 2 | 1 | 0.014 | 0.000 | 0.000 | 13 | 0.00 |
| 2 | 2 | 91.383 | 6.491 | 13.071 | 13 | 0.00 |
| 2 | 3 | 93.363 | 29.347 | 28.416 | 13 | 0.00 |
| 2 | 4 | 137.131 | 46.684 | 43.110 | 11 | 0.00 |
| 2 | 5 | 116.225 | 34.071 | 35.308 | 1 | 0.00 |
| 3 | | 294.524 | 92.467 | 95.466 | | |
| 3 | 1 | 0.019 | 0.000 | 0.000 | 11 | 0.00 |
| 3 | 2 | 88.950 | 4.117 | 11.568 | 11 | 0.00 |
| 3 | 3 | 101.596 | 18.817 | 20.787 | 11 | 0.00 |
| 3 | 4 | 119.423 | 45.696 | 43.545 | 15 | 0.00 |
| 3 | 5 | 261.739 | 38.344 | 42.657 | 5 | 0.00 |
| 3 | 6 | 70.196 | 10.822 | 14.619 | 1 | 0.00 |

*FIG. 4*

METHODS FOR DESIGNING ROLLER CONE BITS BY TENSILE AND COMPRESSIVE STRESSES

CROSS-REFERENCE TO RELATED APPLICATIONS

This application is a continuation-in part of U.S. patent application Ser. No. 09/635,116 filed Aug. 9, 2000, now U.S. Pat. No. 6,873.947, which is a continuation of U.S. Pat. Ser. No. 09/524,088 U.S. Pat. No. 6,516,293, and that patent filed Mar. 13, 2000. This application claims benefit, pursuant to 35 U.S.C. § 120, of the '116 application and the '293 patent, both of which are incorporated by reference in their entireties.

BACKGROUND OF INVENTION

1. Field of the Invention

The invention relates generally to roller cone bits and methods for simulating such bits.

2. Background Art

Roller cone rock bits and fixed cutter bits are commonly used in the oil and gas industry for drilling wells. FIG. 1 shows one example of a conventional drilling system drilling an earth formation. The drilling system includes a drilling rig 10 used to turn a drill string 12 which extends downward into a well bore 14. Connected to the end of the drill string 12 is a roller cone-type drill bit 20, shown in further detail in FIG. 1.

As shown in FIG. 2, roller cone bits 20 typically comprise a bit body 22, having an externally threaded connection at one end 24, and a plurality of roller cones 26 (in this case three) attached to the other end of the bit and able to rotate with respect to the bit body 22. Attached to the cones 26 of the bit 20 are a plurality of cutting elements 28 typically arranged in rows about the surface of the cones 26. The cutting elements 28 can be tungsten carbide inserts, polycrystalline diamond compacts, or milled steel teeth.

The bit body includes one or more legs, each having thereon a bearing journal. The most commonly used types of roller cone drill bits include thee such legs and bearing journals. A roller cone is rotatably mounted to each bearing journal. During drilling, the roller cones rotate about the respective journals while the bit is being rotated. The roller cones include a number of cutting elements, which may be press fit inserts made from tungsten carbide and other materials, or may be milled steel teeth.

The cutting elements engage the formation in a combination of crushing, gouging, and scraping or shearing action which removes small segments of the formation being drilled. The inserts on a cone of a three-cone bit are generally classified as inner-row insert and gage-row inserts. Inner row inserts engage the bore hole bottom, but not the well bore wall. Gage-row inserts engage the well bore wall and sometimes a small outer ring portion of the bore hole bottom. The direction of motion of inserts engaging the rock on a two or three-cone bit is generally in one direction or a very small limited range of directions, i.e., 10 degrees or less.

When a roller cone bit is used to drill in earth formation, the cutting elements, cones, and bit may experience stress. Stress occurs because of the forces applied to the bit in drilling. The amount of stress felt by any given cutting element, cone or the entire bit will depend on the amount of force applied and the surface area of the bit receiving the force. The stress experienced by a cutting element, cone or bit in drilling can be classified into two main categories: tensile stress and compressible stress. The classification into these categories depends on the direction of the forces in relation to the bit. Tensile stress leads to expansion of the bit material, while compressive stress results in compaction of the bit material.

A material can withstand a certain level of tensile stress and compressive stress before it reaches the tensile strength and compressive strength of the material. When the compressive strength is reached, the material fails by compression. When the tensile strength is reached, the material fails breakage. As a practical matter, during drilling of an earth formation, the cutting elements, as well as other parts of the bit are under tensile and compressive stresses.

One significant factor to be considered in the design of the a roller cone bit is the compressive and tensile strengths of the various components of the bit. Components made of a material with a lower tensile strength are preferably not subjected to high tensile stresses. Similarly components made of a lower compressive strength material are preferably not subjected to high compressive stresses. The amount of compressive and tensile stresses impacted on a cutting element will depend in part on the position of such particular cutting element, the position of its row and its cone. Additionally, the cone geometry, as well as the journal angle, which is the angle between the line perpendicular to the axis of the bit and the axis of the bit leg journal, will affect the amount of tensile and compressive stresses induced on a cutting, cone, and bit. By adjusting the cone geometry and journal angle, the induced stresses may vary.

Significant expense is involved in the design and manufacture of drill bits. Therefore, having accurate models for simulating and analyzing the drilling characteristics of bits can greatly reduce the cost associated with manufacturing drill bits for testing and analysis purposes. For this reason, several models have been developed and employed for the analysis and design of 2, 3, and 4 roller cone bits. See, for example, U.S. Pat. Nos. 6,213,225, 6,095,262, 6,412,577, and 6,401,839.

While the prior art methods allow for simulation of drill bit performance, where is still a need for methods to simulate and optimize the tensile and compressive stresses induced on roller cone bits drilling earth formations.

SUMMARY OF INVENTION

In one aspect, the present invention relates to a method for designing a roller cone bit that includes steps of selecting design parameters for the roller cone bit, drilling parameters, and parameters of an earth formation, simulating drilling of the earth formation by the roller cone bit using the selected drilling parameters, calculating drilling performance parameters from the simulated drilling, and analyzing at least one of a tensile stress or a compressive stress parameters for a cutting element of the roller cone bit from the calculated drilling performance parameters.

Other aspects and advantages of the invention will be apparent from the following description and the appended claims.

BRIEF DESCRIPTION OF DRAWINGS

FIG. 4 shows output data in tabular form according to one embodiment of the invention.

DETAILED DESCRIPTION

In one aspect, the invention relates to a method of simulating the tensile and compressive stresses induced on the cutting elements, rows and cones of a roller cone bit. In order to account for the tensile and compressive stresses induced on these bit components, the stresses must be analyzed. Following an analysis, bit parameters can be chosen so as to identify a better design with lower induced stresses, as well as to prevent the tensile and compressive stresses from reaching the tensile and compressive strengths of these various components. Therefore a model to simulate these stresses has been designed and is described below.

U.S. Pat. No. 6,516,293 discloses a simulation method for multiple cone bits, which is assigned to the assignee of the instant application, and is incorporated by reference in its entirety. The simulation model disclosed in the '293 patent provides a means for analyzing the forces acting on the individual cutting elements on the bit, thereby leading to the design of, for example, faster drilling bits having optimal spacing and placing of cutting elements on such bits. By analyzing forces on the individual cutting elements of a bit prior to making the bit, it is possible to avoid expensive trial and error designing of bit configurations that are effective and long lasting.

Figure 1:
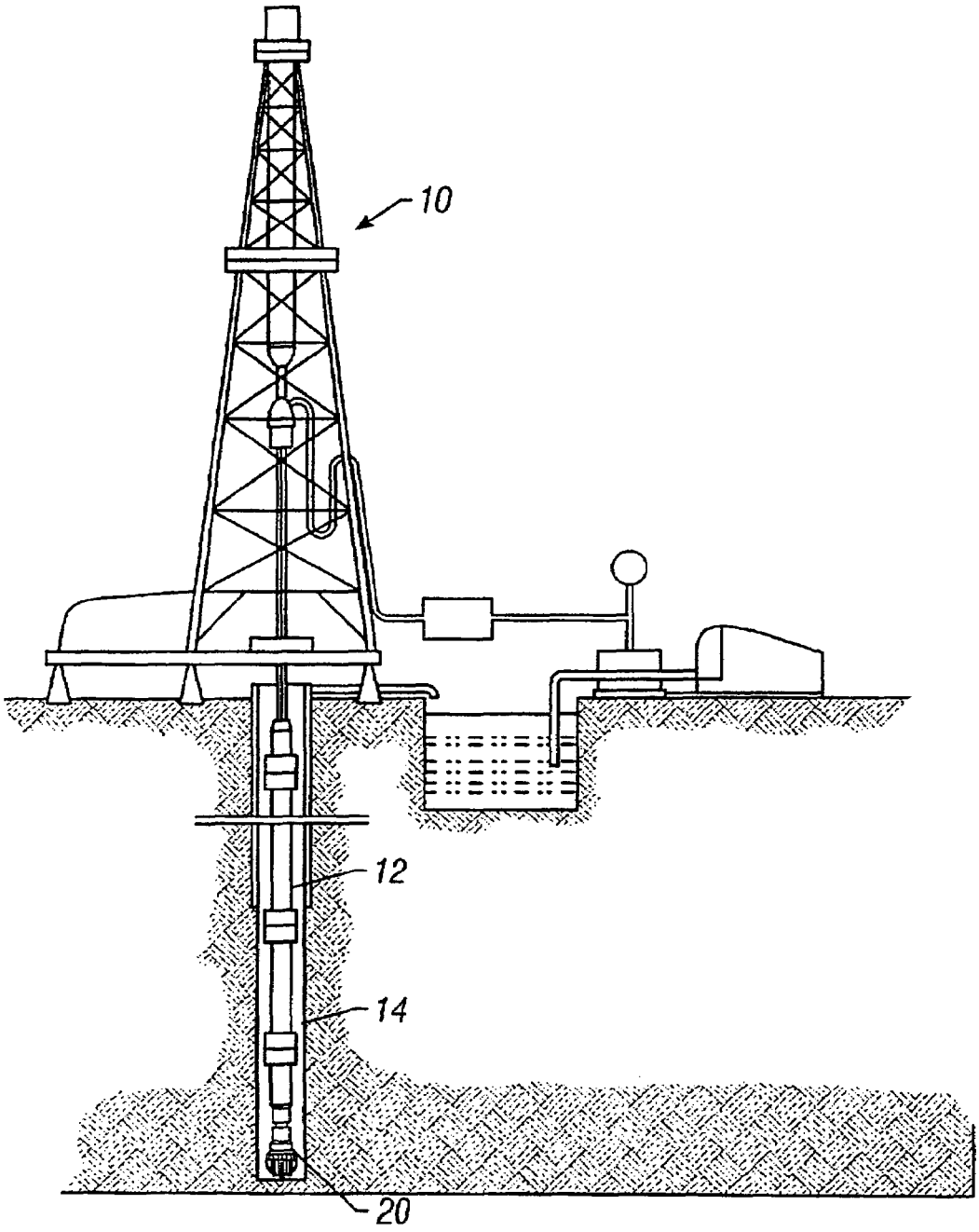
FIG.1 (Prior Art)
FIG. 1 shows a schematic diagram of a drilling system for drilling earth formations having a drill string attached at one end to a roller cone drill bit.
Figure 2:
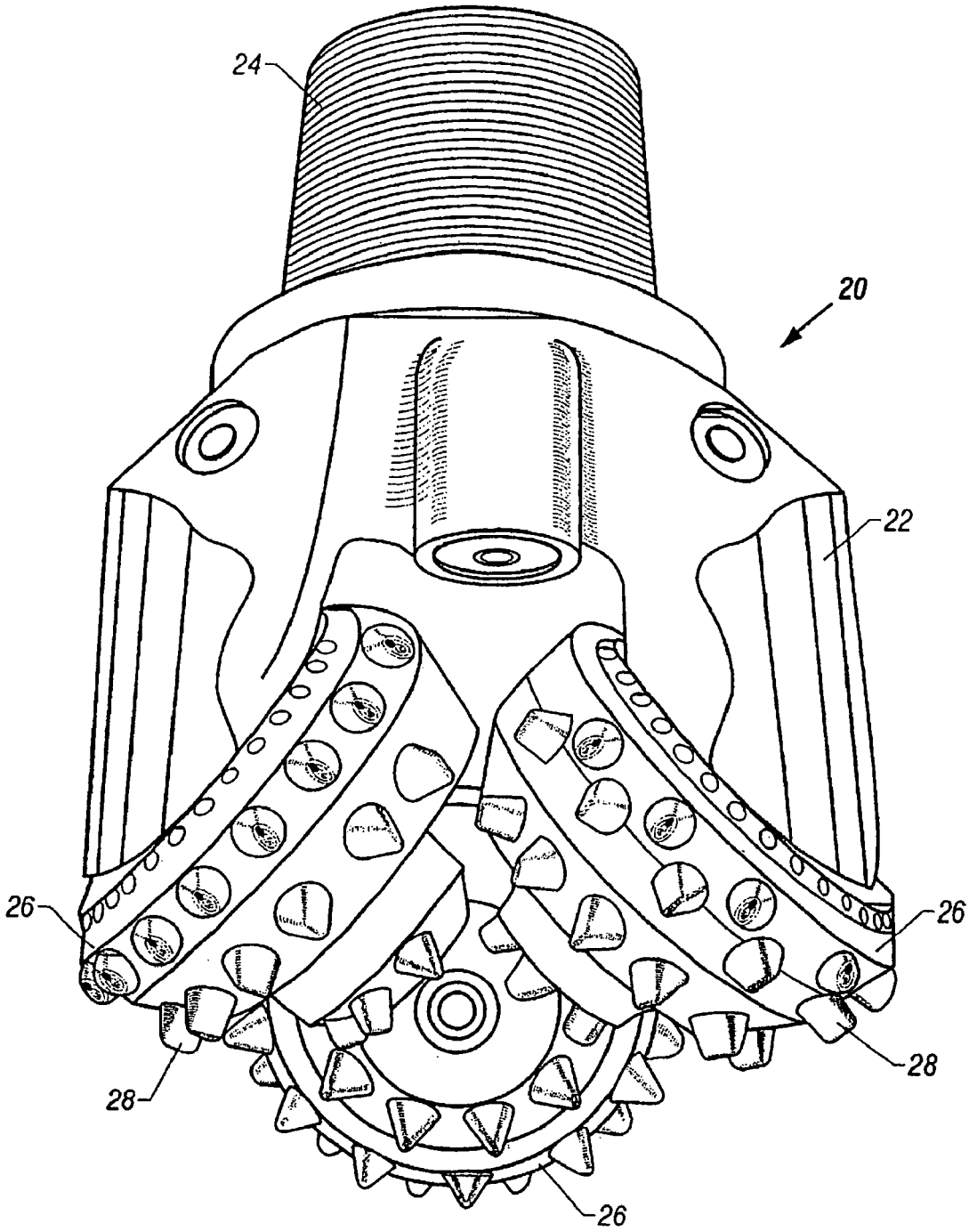
FIG.2 (Prior Art)
FIG. 2 shows a perspective view of a roller cone drill bit.
Figure 3A:
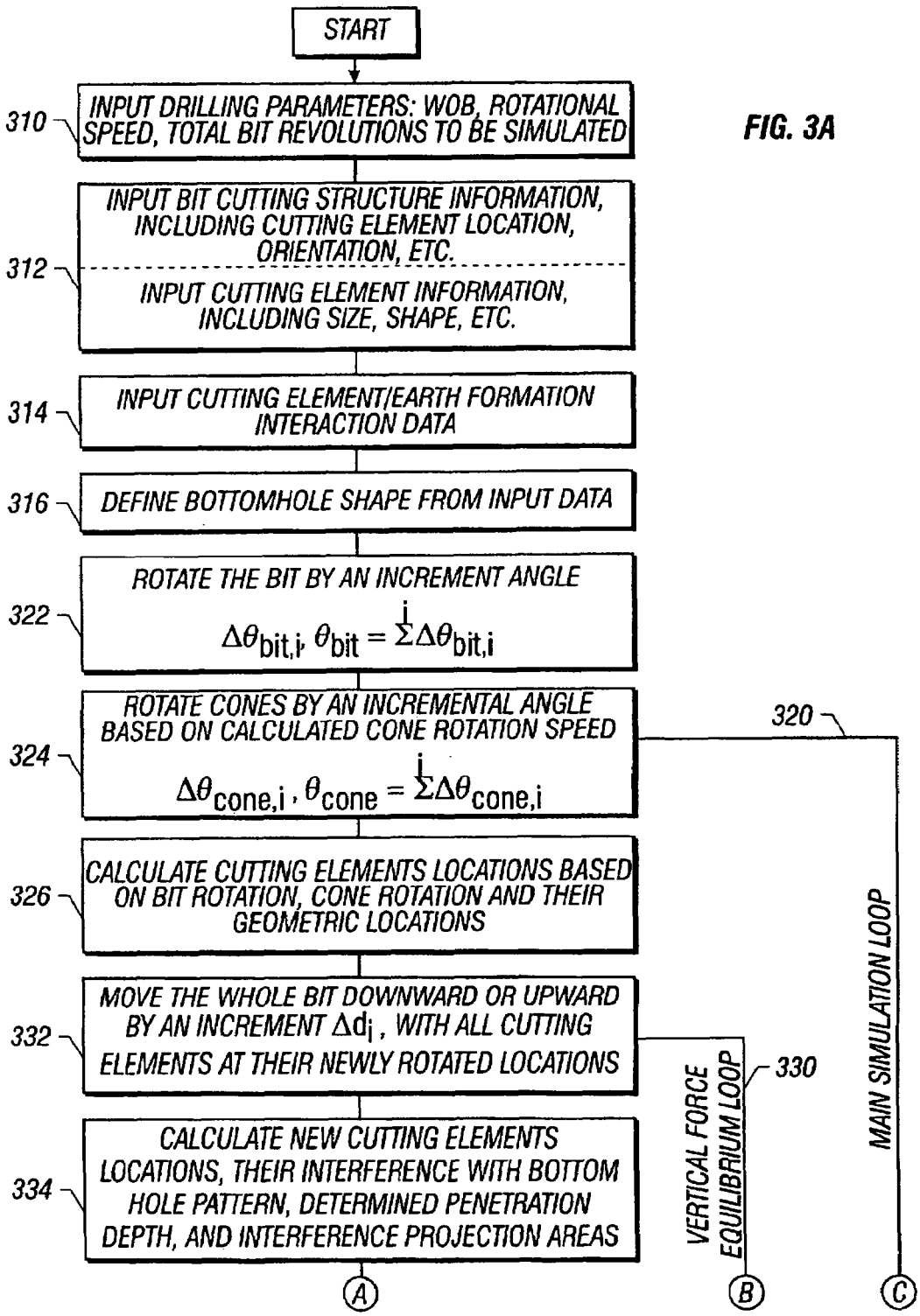
FIG. 3A and FIG. 3B show a flowchart of an embodiment of the invention for generating a visual representation of a roller cone bit drilling earth formations.
Figure 3B:
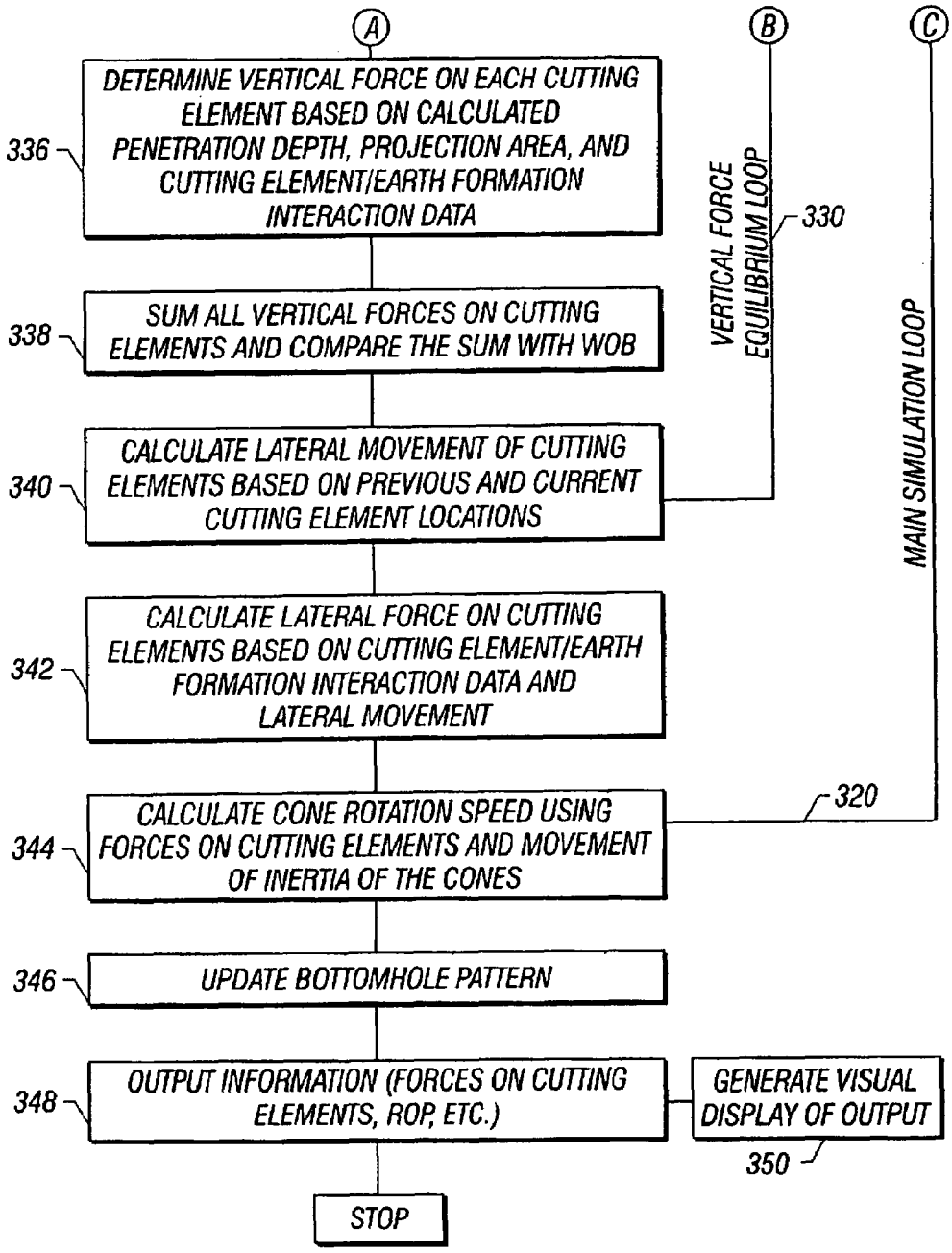

FIGS. 3A and 3B show a flow chart of one embodiment of the invention for generating a visual representation of a roller cone drill bit drilling a selected earth formation. The parameters required as input for the simulation include drilling parameters 310, bit design parameters 312, cutting element/earth formation interaction data 314, and bottomhole geometry data 316. In addition, an initial bit speed/cone speed rotation ratio may be entered. The bottomhole geometry prior to any drilling simulation may be a planar surface, but this is not a limitation on the invention. The input data 310, 312, 314, 316 may be stored in an input library and later retrieved as needed during simulation calculations.

Drilling parameters 310 that may be used include the axial force applied on the drill bit (commonly referred to as the weight on bit, "WOB"), and the rotational speed of the drill bit (typically provided in revolutions per minute, "RPM"). It should be understood that drilling parameters are not limited to these variables, but may include other variables, such as, rotary torque and mud flow volume. Additionally, drilling parameters 310 provided as input may include the total number of bit revolutions to be simulated, as shown in FIG. 3A. However, it should be understood that the total number of revolutions is provided simply as an end condition to signal the stopping point of simulation and is not necessary for the calculations required to simulate or visually represent drilling. Alternatively, another end condition may be employed to determine the termination point of simulation, such as the total drilling depth (axial span) to be simulated or any other final simulation condition. Alternatively, the termination of simulation may be accomplished by operator command or by performing any other specified operation.

Bit design parameters 312 used as input include bit cutting structure information, such as the cutting element location and orientation on the roller cones, and cutting element information, such as cutting element size(s) and shape(s). Bit design parameters 312 may also include bit diameter, cone diameter profile, cutting element count, cutting element height, and cutting element spacing between individual cutting elements. The cutting element and roller cone geometry can be converted to coordinates and used as input for the invention. Preferred methods for bit design parameter inputs include the use of 3-dimensional CAD solid or surface models to facilitate geometric input.

Cutting element/earth formation interaction data 314 used as input include data which characterize the interactions between a selected earth formation (which may have, but need not necessarily have, known mechanical properties) and an individual cutting element having a known geometry.

Bottomhole geometry data 316 used as input include geometrical information regarding the bottomhole surface of an earth formation, such as the bottomhole shape. As previously explained, the bottomhole geometry may be planar at the beginning of a simulation, but this is not a limitation on the invention. The bottomhole geometry can be represented as a set of axial (depth) coordinates positioned within a defined coordinate system, such as in a cartesian coordinate system. In this embodiment, a visual representation of the bottomhole surface is generated using a coordinate mesh size of, for example, 1 millimeter. Note that the mesh size shown is for illustration only and is not a limitation on the invention.

As shown in FIG. 3A, once the input data 310-316 are entered or otherwise made available, calculations in the main simulation loop 320 can be carried out. To summarize the functions performed in the main simulation loop 320, drilling simulation is incrementally calculated by "rotating" the bit through an incremental angle, and then iteratively determining the vertical (axial) displacement of the bit corresponding to the incremental bit rotation. Once the vertical displacement is obtained, the lateral forces on the cutting elements may be calculated and used to determine the current rotation speed of the cone. Finally, the bottomhole geometry may be updated by removing the deformed earth formation resulting from the incremental drilling calculated in the simulation loop 320. A more detailed description of the elements in the simulation loop 320 is as follows.

The first element in the simulation loop 320 in FIG. 3A involves "rotating" the roller cone bit (numerically) by the selected incremental angle amount, $\Delta\theta_{bit,i}$, 322. In this example embodiment, the selected incremental angle is 3 degrees. It should be understood that the incremental angle is a matter of convenience for the system designer and is not intended to limit the invention. The incremental rotation of the bit results in an incremental rotation of the cone on the bit, $\Delta\theta_{cone,i}$. Determination of the incremental rotation of the cone, $\Delta\theta_{cone,i}$, resulting from the incremental rotation of the bit, $\Delta\theta_{bit,i}$, requires knowledge of the rotational speed of the cone. In one example, the rotational speed of the cone is determined by the rotational speed of the bit and the effective radius of the "drive row" of the cone. The effective radius is generally related to the radial extent of the cutting elements that extend axially the farthest from the axis of rotation of the cone; these cutting elements are generally located on a so-called "drive row." Thus, the rotational speed of the cone can be defined or calculated based on the known rotational speed of the bit and the defined geometry of the cone provided as input (e.g., the cone diameter profile, and cone axial offset). Then, the incremental rotation of the cone, $\Delta\theta_{cone,i}$, is calculated based on incremental rotation of the bit, $\Delta\theta_{bit,i}$, and the calculated rotational speed of the cone 324.

Once the incremental angle of each cone $\Delta\theta_{cone,i}$ is calculated, the new locations of the cutting elements, $p_{\theta,i}$ are computed based on bit rotation, cone rotation, and the immediately previous locations of the cutting elements $P_{i-1}$. The new locations of the cutting elements 326 can be determined by geometric calculations known in the art. Based on the new locations of the cutting elements, the vertical displacement of the bit resulting from the incremental rotation of the bit is, in this embodiment, iteratively computed in a vertical force equilibrium loop 330.

In the vertical force equilibrium loop 330, the bit is "moved" (axially) downward (numerically) a selected initial incremental distance $\Delta d_i$, and new cutting element locations $p_i$ are calculated, as shown at 332 in FIG. 3A. In this example, the selected initial incremental distance is 2 mm. It should be understood that the initial incremental distance selected is a matter of convenience for the system designer and is not intended to limit the invention. Then, the cutting element interference with the existing bottomhole geometry is determined, at 334. This includes determining the depth of penetration of each cutting element into the earth formation and a corresponding interference projection area. The depth of penetration is defined as the distance from the formation surface a cutting element penetrates into an earth formation. This distance can range from zero (no penetration) to the full height of the cutting element (full penetration). The interference projection area is the fractional amount of surface area of the cutting element that actually contacts the earth formation. Upon first contact of a cutting element with the earth formation, such as when the formation presents a smooth, planar surface to the cutting element, the interference projection area is substantially equal to the total contact surface area corresponding to the depth of penetration of the cutting element into the formation.

However, upon subsequent contact of cutting elements with the earth formation during simulated drilling, each cutting element may have subsequent contact over less than the total contact area. This less than full area contact comes about as a result of the formation surface having "craters" (deformation pockets) made by previous contact with a cutting element. Fractional area contact on any of the cutting elements reduces the axial force on those cutting elements, which can be accounted for in the simulation calculations.

Once the cutting element/earth formation interaction is determined for each cutting element, the vertical force, $f_{V,I}$, applied to each cutting element is calculated based on the calculated penetration depth, the projection area, and the cutting element/earth formation interaction data 312. This is shown at 336 in FIG. 3B. Thus, the axial force acting on each cutting element is related to the cutting element penetration depth and the cutting element interference projection area. In this embodiment, a simplifying assumption used in the simulation is that the WOB is equal to the summation of vertical forces acting on each cutting element. Therefore, the vertical forces, $f_{V,i}$, on the cutting elements are summed to obtain a total vertical force $F_{V,i}$ on the bit, which is then compared to the selected axial force applied to the bit (the WOB) for the simulation, as shown at 338. If the total vertical force $F_{V,i}$ is greater than the WOB, the initial incremental distance $\Delta d_i$ applied to the bit is larger than the incremental axial distance that would result from the selected WOB. If this is the case, the bit is moved up a fractional incremental distance (or, expressed alternatively, the incremental axial movement of the bit is reduced), and the calculations in the vertical force equilibrium loop 330 are repeated for the resulting incremental distance.

If the total vertical force $F_{V,i}$ on the cutting elements, using the resulting incremental axial distance is less than the WOB, the incremental distance $\Delta d_i$ applied to the bit is smaller than the incremental axial distance that would result from the selected WOB. In this case, the bit is moved further down, and the calculations in the vertical force equilibrium loop 330 are repeated for the second resulting incremental distance. The vertical force equilibrium loop 330 calculations iteratively continue until an appropriate incremental axial displacement for the bit is obtained that results in a total vertical force on the cutting elements substantially equal to the selected WOB, o within a selected error range.

Once the appropriate incremental axial displacement, $\Delta d_i$, of the bit is obtained, the lateral movement of the cutting elements is calculated based on the previous, $p_{i-1}$, and current, $p_i$, cutting element locations, as shown at 340. Then, the lateral force, $f_{L,i}$, acting on the cutting elements is calculated based on the lateral movement of the cutting elements and cutting element/earth formation interaction data, as shown at 342. Then, the cone rotation speed is calculated based on the forces on the cutting elements and the moment of inertia of the cone, as shown at 344.

Finally, the bottomhole pattern is updated, at 346, by calculating the interference between the previous bottomhole pattern and the cutting elements during the current incremental drilling step, and based on the cutting element/earth formation interactions, "removing" the formation resulting from the incremental rotation of the selected bit with the selected WOB. In this example, the interference can be represented by a coordinate mesh or grid having 1 mm grid blocks.

This incremental simulation loop 320 can then be repeated by applying a subsequent incremental rotation to the bit 322 and repeating the calculations in the incremental simulation loop 320 to obtain an updated bottomhole geometry. Using the total bit revolutions to be simulated as the termination command, for example, the incremental displacement of the bit and subsequent calculations of the simulation loop 320 will be repeated until the selected total number of bit revolutions to be simulated is reached. Repeating the simulation loop 320 as described above will result in simulating the performance of a roller cone drill bit drilling earth formations with continuous updates of the bottomhole pattern drilled, simulating the actual drilling of the bit in a selected earth formation. Upon completion of a selected number of operations of the simulation loops 320, results of the simulation can be programmed to provide output information at 348 characterizing the performance of the selected drill bit during the simulated drilling, as shown in FIG. 3B. It should be understood that the simulation can be stopped using any other suitable termination indicator, such as a selected axial displacement.

Referring back to the embodiment of the invention shown in FIGS. 3A and 3B, drilling parameters 310, bit design parameters 312, and bottomhole parameters 316 required as input for the simulation loop of the invention are distinctly defined parameters that can be selected in a relatively straight forward manner. On the other hand, cutting element/earth formation interaction data 314 are not defined by a clear set of parameters, but can be obtained in a number of different ways.

In one embodiment of the invention, cutting element/earth formation interaction data 314 may comprise a library of data obtained from actual tests performed using selected cutting elements, each having a known geometry, on selected earth formations. In this embodiment, the tests include using a roller cone bit having a known geometry on the selected earth formation with a selected force. The selected earth formation may have known mechanical properties, but it is not essential that the mechanical properties be known. Then, the resulting grooves formed in the formation as a result of the interactions between the inserts and the formation are analyzed. These tests can be performed for different cutting elements, different earth formations, and different applied forces, and the results analyzed and stored in a library for use by a simulation method of the invention. These tests can provide good representation of the interactions between cutting elements and earth formations under selected conditions.

In one embodiment, these tests may be repeated for each selected cutting element in the same earth formation under different applied loads, until a sufficient number of tests are performed to characterize the relationship between interference depth and impact force applied to the cutting element. Tests are then performed for other selected cutting elements and/or earth formations to create a library of crater shapes and sizes and information regarding interference depth/impact force for different types of roller cone bits in selected earth formations.

Alternatively, single insert tests, such as those described in U.S. Pat. No. 6,516,293, may be used in simulations to predict the expected deformation/fracture crater produced in a selected earth formation by a selected cutting element under specified drilling conditions.

In another embodiment of the invention, techniques such as Finite Element Analysis, Finite Difference Analysis, and Boundary Element Analysis may be used to determine the motion of the cone. For example, the mechanical properties of an earth formation may be measured, estimated, interpolated, or otherwise determined, and the responses of the earth formation to cutting element interactions may be calculated using Finite Element Analysis.

Thus, the above methodology provides a method for simulating a roller cone bit. Some embodiments of the invention include graphically displaying the simulation of the roller cone bit and other embodiments include a method for designing a roller cone bit. In one embodiment, this method includes selecting an initial bit design, calculating the performance of the initial bit design, then adjusting one or more design parameters and repeating the performance calculations until an optimal set of bit design parameters is obtained. In another embodiment, this method can be used to analyze relationships between bit design parameters and drilling performance of a bit. In a third embodiment, the method can be used to design a roller cone bit having enhanced drilling characteristics. For example, the method can be used to analyze row spacing optimization, intra-insert spacing optimization, tracking, and forces acting on rows and cutting elements.

After the simulation phase is complete, the collected data, which includes the tensile and compressive stresses, may be displayed in a number of formats. Those having ordinary skill in the art will appreciate that a number of mathematical and graphical techniques may be used to display the data accumulated during the simulation phase and that no particular technique is intended to limit the scope of the present invention. In designing a roller cone bit, one factor that might be of interest to a designer is the tensile and compressive stresses endured by the roller cone bit cutting elements during the simulated drilling.

In one embodiment, the stresses calculated are the stresses induced at the root of the inserts, that is, at the location where the insert meet the cone. There are two components to the these stresses: the stress caused by compressive forces that are along the axis of the inserts and the stress caused by the bending of the insert due to the forces that are perpendicular to the axis of the inserts.

As used herein, the stress due to the compressive load is a function of the force applied per the cross-sectional area perpendicular to the force. In other words the compressive load can be written as:

$$\sigma_{cl} = \frac{F}{A} \tag{1}$$

where F is the applied force and A is the cross sectional area perpendicular to the applied force.

The stress due to bending places one side of the insert in tension and the other side of the insert in compression. This stress is a function of the bending moment of at the insert root times the radius of the insert at the root per the moment of inertia at the cross section of the insert at the root, and it can be written as:

$$\sigma_b = \frac{M * h}{J} \tag{2}$$

where M is the bending moment at the insert root, h is equal to the radius of the insert at the root, and J is the moment of inertia of the cross section of the insert at the root. The bending moment is caused by all forces perpendicular to the insert's axis, which can be obtained from simulation. Another Patent Application, filed simultaneously with the present application, entitled "Bending Moment," assigned to the present assignee, and having the same inventor, discloses the bending moment in more detail and is expressly incorporated by reference in its entirety.

The compressive stress induced on an insert is calculated by adding the stress due to the compressive load and the stress due to bending and can be written as:

$$\sigma_c = \sigma_{cl} + \sigma_b \tag{3}$$

The tensile stress induced on an insert is calculated by subtracting the stress due to bending from the stress due to compressive load and can be written as:

$$\sigma_t = \sigma_{cl} - \sigma_b \tag{4}$$

If the stress due to bending is more than the stress due to the compressive load, the insert will be under tensile stress. However, if the stress due to bending is less than the stress due to the compressive load, both sides of the insert will be under compressive stress, with the side of the insert under tension due to the bending having a compressive stress less than side of the insert under compression due to the bending. Thus, the two compressive and tensile stresses are related, but not necessarily equivalent.

The stress data collected after the simulation may include the maximum, median and average tensile and compressive stresses encountered by any given insert. The stresses may also be summed for the inserts on a given row to give the maximum, median, and average tensile and compressive stresses encountered for that given row. Additionally, the stresses may be summed for the inserts on one cone to give the maximum, median, and average tensile and compressive stresses encountered by that cone. In accordance with one embodiment of the invention, the output data associated with the maximum, median, and average tensile and compressive stresses may be displayed in tabular form, as shown in FIG. 4.

In one aspect, the calculated stresses allow for a relative comparison between two bit designs, to identify the better design. Two bit designs that undergo the simulated drilling are subjected to drilling parameters, including the WOB and the RPM. If one design produces an equal or better rate of penetration (ROP) with less induced stress than the other, this design is considered the better design between the two designs.

In another aspect, the calculated compressive and tensile stresses are compared to the compressive and tensile strengths of components of the bit so as to avoid failure of the bit by compression or breakage. If the compressive stress induced on a component reaches the compressive strength of the material, the material will fail by compression. If the tensile stress induced on a component reaches the tensile strength of the material, the material will fail by breakage.

In yet another aspect, a drill bit used in the field which has experienced insert breakage may be analyzed. After drilling, if the drill bit contains a row of cutting elements for which higher levels of breakage is observed, the drilling of the bit may be simulated according to the above described methodology to determine whether high tensile and compressive stresses are being induced on the cutting elements row, causing the observed breakage.

Thus, in one aspect, the invention provides a method for designing roller cone bits. In one embodiment, this method includes selecting an initial bit design, calculating the performance of the initial bit design, then adjusting one or more design parameters and repeating the performance calculations until an optimal set of bit design parameters is obtained. In another embodiment, this method can be used to analyze relationships between bit design parameters and drilling performance of a bit. In yet another embodiment, the method can be used to design roller cone bits having enhanced drilling characteristics. In particular, the method can be used to analyze tensile stress and compressive stress.

Output information that may be considered in identifying bit designs possessing enhanced drilling characteristics or an optimal set of parameters include both tensile and compressive stresses. This output information may be in the form of visual representation parameters calculated for the visual representation of selected aspects of drilling performance for each bit design, or the relationship between values of a bit parameter and the drilling performance of a bit. Alternatively, other visual representation parameters may be provided as output as determined by the operator or system designer. Additionally, the visual representation of drilling may be in the form of a visual display on a computer screen. It should be understood that the invention is not limited to these types of visual representations, or the type of display. The means used for visually displaying aspects of simulated drilling is a matter of convenience for the system designer, and is not intended to limit the invention.

As set forth above, the invention can be used as a design tool to simulate and optimize the performance of roller cone bits drilling earth formations. Further the invention enables the analysis of drilling characteristics of proposed bit designs prior to their manufacturing, thus, minimizing the expense of trial and error designs of bit configurations. Further, the invention permits studying the effect of bit design parameter changes on the drilling characteristics of a bit and can be used to identify bit design that exhibit desired drilling characteristics.

Figure 5:
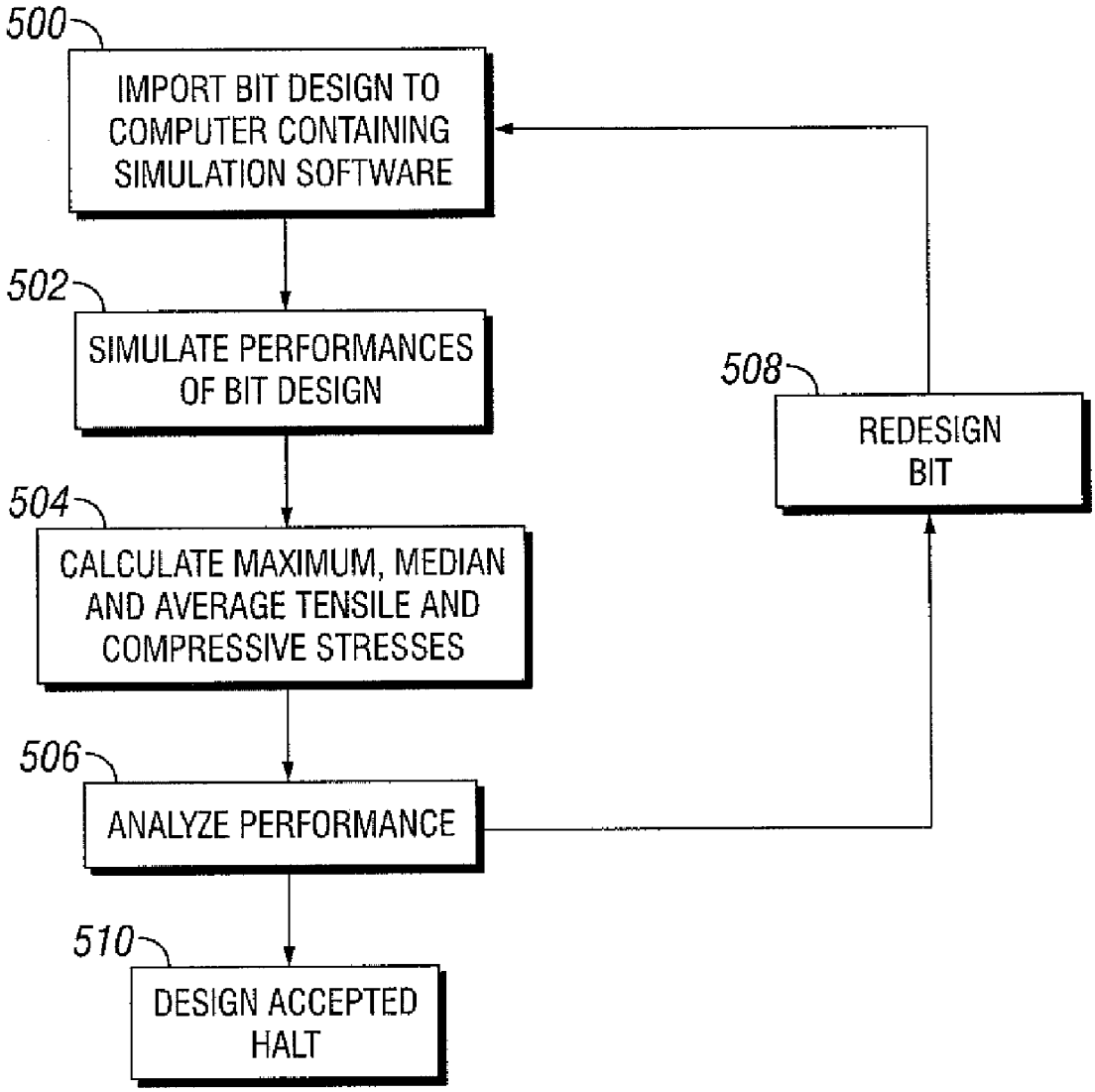
FIG. 5 shows a flowchart of one embodiment of the invention for simulating drilling.

Thus, in one embodiment of the invention, shown in FIG. 5 a designer imports a bit design (step 500) into a computer containing the simulation software in accordance with an embodiment of the present invention. The performance of this bit design is then simulated (step 502). During the simulation step (502), the tensile and compressive stresses induced on cutting elements, rows, and cones may be monitored by the designer. At the end of the simulation step (502), the maximum, median, and average tensile and compressive stresses are calculated (504), and the performance is analyzed (step 506).

After the tensile and compressive stresses are analyzed, the design may be accepted or rejected (based on pre-set criteria, or based on the experience of the designer). If the bit is rejected, the bit may be redesigned (step 508). The orientation, spacing, number, location of the cutting elements and/or rows, journal angle and cone geometry may be modified, for example. Those having skill in the art will appreciate that bit designs may be changed in a variety of ways, and no limitation on the scope of the present invention is intended by listing specific changes. If the design is accepted, the design process is halted (step 510).

In another aspect, the invention provides a method for optimizing drilling parameters of a roller cone bit, such as, for example, the weight on bit (WOB) and rotational speed of the bit (RPM). In one embodiment, this method includes selecting a bit design, drilling parameters, and earth formation desired to be drilled; calculating the performance of the selected bit drilling the earth formation with the selected drilling parameters; then adjusting one or more drilling parameters and repeating drilling calculations, until an optimal set of drilling parameters is obtained. This method can be used to analyze relationships between bit drilling parameters and drilling performance of a bit. This method can also be used to optimize the drilling performance of a selected roller cone bit design.

As described above, the invention can be used as a design tool to simulate and optimize the performance of roller cone bits drilling earth formations. The invention enables the analysis of drilling characteristics of proposed bit designs prior to their manufacturing, thus, minimizing the expense of trial and error designs of bit configurations. The invention enables the analysis of the effects of adjusting drilling parameters on the drilling performance of a selected bit design. Further, the invention permits studying the effect of bit design parameter changes on the drilling characteristics of a bit and can be used to identify bit design which exhibit desired drilling characteristics. Further, the invention permits the identification of an optimal set of drilling parameters for a given bit design. Further, use of the invention leads to more efficient designing and use of bits having enhanced performance characteristics and enhanced drilling performance of selected bits.

In one embodiment of the invention, the designer determines a "stop" point for the design. That is, the individual designer makes a determination as to when a bit is optimized for a given set of conditions. In other embodiments, however, the process may be automated to reach a pre-selected end condition. For example, the number of teeth on the bit could be successively iterated until a five percent increase in ROP is seen.

Advantages of embodiments of the invention may include one or more of the following. Simulation of tensile and compressive stresses on roller cone bits would enable analyzing the drilling characteristics of proposed bit designs and permit studying the effect of bit design parameter changes on the drilling characteristics of a bit. Such analysis and study would enable the optimization of roller cone drill bit designs to produce bits which exhibit desirable drilling characteristics and longevity. Similarly, the ability to simulate roller cone bit performance would enable studying the effects of altering the drilling parameters on the drilling performance of a given bit design. Such analysis would enable the optimization of drilling parameters for purposes of maximizing the drilling performance of a given bit.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method for designing a roller cone bit, comprising (a) selecting design parameters for the roller cone bit, drilling parameters, and parameters of an earth formation;

(b) simulating drilling of the earth formation by the roller cone bit using the selected drilling parameters;

(c) calculating drilling performance parameters from the simulated drilling;

(d) analyzing at least one of a tensile stress and a compressive stress parameters for a cutting element of the roller cone bit from the calculated drilling performance parameters; and (e) outputting at least one of the tensile stress or compressive stress parameter, (f) adjusting at least one of the design parameters for the roller cone bit, drilling parameters, and the parameters of the earth formation; and (g) repeating steps (b)-(d) to chance a simulated performance of the roller cone bit;

wherein the tensile stress parameter comprises at least one of a maximum tensile stress, a median tensile stress, and an average tensile stress;

wherein the compressive stress parameter comprises at least one of a maximum compressive stress, a median compressive stress, and an average compressive stress.

2. The method of claim 1, wherein the tensile stress parameter is calculated for the cutting element of the roller cone bit from the calculated drilling performance parameters.

3. The method of claim 1, wherein the tensile stress parameter is calculated for a row of cutting element of the roller cone bit from the calculated drilling performance parameters.

4. The method of claim 1, wherein the tensile stress parameter is calculated for a roller cone of cutting element of the roller cone bit from the calculated drilling performance parameters.

5. The method of claim 1, wherein the compressive stress parameter is calculated for the cutting element of the roller cone bit from the calculated drilling performance parameters.

6. The method of claim 1, wherein the compressive stress parameter is calculated for a row of cutting element of the roller cone bit from the calculated drilling performance parameters.

7. The method of claim 1, wherein the compressive stress parameter is calculated for a roller cone of cutting element of the roller cone bit from the calculated drilling performance parameters.

8. The method of claim 1, wherein both the tensile stress parameter and the compressive stress parameter are analyzed.

9. The method of claim 1, wherein the tensile stress parameter for the cutting element is related to the compressive stress parameter for the cutting element.

10. A method for optimizing drilling performance of a roller cone bit design, comprising:

selecting a roller cone bit design, drilling parameters, and parameters of an earth formation desired to be drilled;

calculating at least one of the tensile stress value and compressive stress value induced on at least one cutting element on the roller cone bit based on the drilling parameters and the parameters of the earth formation;

adjusting at least one of the roller cone bit design, the drilling parameters, and the parameters of the earth formation desired to be drilled according to at least one of the tensile stress value and compressive stress value;

repeating the calculating and adjusting until an optimized drilling performance is achieved; and outputting at least one of the tensile stress value, compressive stress value, and optimized drilling performance;

wherein the tensile stress parameter comprises at least one of a maximum tensile stress, a median tensile stress, and an average tensile stress;

wherein the compressive stress parameter comprises at least one of a maximum compressive stress, a median compressive stress, and an average compressive stress.

11. The method of claim 10, wherein both the tensile stress value and compressive stress value are calculated.

* * * * *